US006781523B2

(12) United States Patent
Matsui et al.

(10) Patent No.: US 6,781,523 B2
(45) Date of Patent: Aug. 24, 2004

(54) ROAD TRAFFIC MONITORING SYSTEM

(75) Inventors: Toshiaki Matsui, Koganei (JP); Harunobu Yuzawa, Zama (JP); Akira Kobayashi, Zama (JP)

(73) Assignees: National Institute of Information and Communications Technology, Koganei (JP); Kinashi Denki Manufacturing Co., Ltd., Zama (JP)

( * ) Notice: Subject to any disclaimer, the term of this patent is extended or adjusted under 35 U.S.C. 154(b) by 237 days.

(21) Appl. No.: 10/108,469

(22) Filed: Mar. 29, 2002

(65) Prior Publication Data

US 2002/0145541 A1 Oct. 10, 2002

(30) Foreign Application Priority Data

Mar. 30, 2001 (JP) ..... 2001-101321

(51) Int. Cl.[7] ..... G08G 1/07

(52) U.S. Cl. ..... 340/910; 340/933; 340/934; 701/118

(58) Field of Search ..... 340/910, 933, 340/934, 938, 928, 937; 701/117, 118

(56) References Cited

U.S. PATENT DOCUMENTS

| | | | | | |
|---|---|---|---|---|---|
| 5,406,275 | A | * | 4/1995 | Hassett et al. | 340/933 |
| 5,686,906 | A | * | 11/1997 | Ono et al. | 340/928 |
| 5,757,286 | A | * | 5/1998 | Jonsson et al. | 340/937 |
| 5,801,943 | A | | 9/1998 | Nasburg | |
| 6,112,152 | A | | 8/2000 | Tuttle | |
| 6,442,474 | B1 | * | 8/2002 | Trajkovic et al. | 701/117 |
| 6,489,920 | B1 | * | 12/2002 | Anders et al. | 342/179 |
| 6,650,948 | B1 | * | 11/2003 | Atkinson et al. | 700/66 |

FOREIGN PATENT DOCUMENTS

| | | |
|---|---|---|
| EP | 0 843 295 | 5/1998 |
| FR | 2 619 944 | 3/1989 |
| GB | 1 462 055 | 1/1977 |
| GB | 2 227 866 | 8/1990 |
| JP | 55-116176 | 9/1980 |
| JP | 60-204099 | 10/1985 |
| JP | 02-159699 | 6/1990 |
| JP | 02-263286 | 10/1990 |
| JP | 6-70833 | 9/1994 |
| JP | 7-104998 | 11/1995 |
| JP | 2596554 | 1/1997 |
| JP | 2709995 | 10/1997 |
| JP | 2729977 | 12/1997 |
| JP | 11-161894 | 6/1999 |
| JP | 2965714 | 8/1999 |
| JP | 2981888 | 9/1999 |
| JP | 2000-155891 | 6/2000 |
| JP | 2000-306190 | 11/2000 |
| JP | 2000-322684 | 11/2000 |
| WO | WO 94/07206 | 3/1994 |

* cited by examiner

*Primary Examiner*—Toan N. Pham
(74) *Attorney, Agent, or Firm*—Oblon, Spivak, McClelland, Maier & Neustadt, P.C.

(57) ABSTRACT

Roadside wireless devices are installed at roadside positions corresponding to the traffic lanes entering an intersection. Roadside wireless devices are also installed at roadside positions corresponding to the traffic lanes exiting an intersection. The roadside wireless devices on the entrance side receive an identification number from vehicle-mounted wireless ID devices of vehicles entering the intersection and transmit them to a roadside traffic monitoring device. Thereafter, the roadside wireless devices on the exit side receive an identification number from the vehicle-mounted wireless ID devices of vehicles exiting the intersection and transmit them to the roadside traffic monitoring device. From the identification numbers received, the roadside traffic monitoring device is able to determine the entrance from which a vehicle judged to be the same one had entered and the exit from which it exited, along with the type of vehicle. Short-term and long-term statistical data on the flow of vehicles and the situation of road usage can be acquired efficiently.

120 Claims, 10 Drawing Sheets

ROAD TRAFFIC MONITORING SYSTEM

BACKGROUND OF THE INVENTION

1. Field of the Invention

This invention relates to a monitoring system for vehicular traffic on roads, and more specifically to a road traffic monitoring system that monitors monitoring areas consisting of ordinary roads, intersections between them, entrances to and exits from expressways, and connectors between expressways, or namely strategic traffic areas where three or more entrances or exits intersect, that is effective in monitoring the vehicular traffic situation at these monitoring areas, that determines the vehicular traffic situation in real time, that measures and monitors the vehicular traffic situation by time zone, day and month, and by season throughout the year, and that when combined with statistical processing functions, contributes to optimal traffic control and effective utilization of the road traffic network.

2. Description of the Prior Art

Conventional vehicular traffic survey methods and road traffic monitoring methods include methods involving the counting of the number of passing cars by survey personnel stationed at intersections or the like, as well as automatic measurement methods such as ultrasonic-based measurement methods, magnetic detector-based measurement methods, and methods wherein the vehicle types, number of vehicles and the like are measured using image recognition technology from image signals obtained from television cameras. This information is used to provide road traffic condition information and for road traffic control.

Examples of ultrasonic-based measurement methods include the vehicle trip time measurement disclosed in the Publication of Examined Japanese Patent Application JP-B-7-104998 and the vehicle type determination method disclosed in Japanese Patent No. 2596554. FIG. 10 is an explanatory diagram showing an example of the construction of a road traffic monitoring system that uses known ultrasonic technology. Here, an ultrasonic transceiver 26 installed above the road emits ultrasonic, and the ultrasonic reflected from the road surface or vehicle 27 is received by the ultrasonic transceiver 26 installed above the same road. The roundtrip time from emission until the reflected wave was received is measured and compared against the time required for a wave reflected from the road to arrive, stored in advance as data. A judgment is made as to whether or not a vehicle is passing upon the road, and if a vehicle is determined to be passing, then the height of the vehicle 27 is calculated from the time for the reflected wave to arrive, thereby determining the type of vehicle. In addition, this scheme is such that the vehicle height data is measured based on the transmission spacing of the transmitted signal, and thus the vehicle type is determined to be either a small vehicle or large vehicle.

In addition, examples of magnetic sensor-based measurement methods include the vehicle detection sensor and traffic flow measurement system disclosed in Japanese Patent No. 2729977 and the vehicle type determination method disclosed in Japanese Patent No. 2709995. In these methods which use magnetic sensors, a plurality of magnetic sensors installed upon the road detect the magnetic characteristics of a vehicle, and the passage of a vehicle is determined if the difference between a pair of maxima and minima in the magnetic data present during a fixed period of time is above a fixed value. The type of vehicle is determined by the magnitude of the difference, its direction of travel is determined from the advancement or retardation of the detected phase difference, while its speed is calculated from the magnitude of the phase difference.

FIG. 11 is an explanatory diagram showing the concept of road traffic monitoring technology using a known optical reading device. In this case, a constitution that uses an optical reading device 24 for optical photography installed above the lane and an image processor 28 is adopted. In a scheme for road traffic monitoring, the image processor 28 extracts an image of the license plate portion from the image of the photographed vehicle 27, character recognition is performed on the extracted image and the license plate information is used as vehicle-number data. Thus, the determination of the vehicle type and position can be performed by the optical reading device 24 (Publication of Examined Japanese Patent Application JP-B-06-070833), while the travel time of a vehicle passing between several points can be determined by comparison with the results of detection at other points (Japanese Patent No. 2965714). To wit, by means of the system shown in the present diagram, it is possible to measure the time required for an identified vehicle to travel and also monitor the traffic situation.

However, among the aforementioned vehicular traffic survey methods and road traffic monitoring methods, methods involving the counting of the number of passing cars by the visual observation of survey personnel become work in which people are directly involved, so they are inappropriate for constant surveys or monitoring. In addition, among the aforementioned automatic measurement methods related to road traffic monitoring, the ultrasonic-based measurement methods are schemes wherein ultrasonic emitted from an ultrasonic transceiver installed above the road is reflected from the road surface or vehicle and received, so it has drawbacks in that it is difficult to determine the type of vehicle other than how large it is, and depending on the situation of vehicle flow, errors in the count may easily occur. In addition, while schemes wherein a magnetic detector installed above the road detects the magnetic characteristics of vehicles can offer high reliability in the count of the number of passing vehicles, determination of the type of vehicle is difficult, in the same manner as in the case of an ultrasonic scheme, and it is difficult to survey or monitor the overall flow of vehicles especially at intersections where vehicles can go straight or turn left or right. Moreover, in road traffic monitoring schemes using television cameras, while it is possible to recognize and record an image of the situation of congestion from the photographed images, there are many unsolved problems regarding quantitative analysis and statistical processing. Furthermore, in a scheme wherein the passing vehicles traveling upon a road are photographed, the license plates are extracted from the image data and character recognition is performed so that the license plate information is used as vehicle-number data in a scheme using image recognition to monitor the traffic situation, while this has the possibility of permitting various types of statistical monitoring to be performed regarding the traffic flow situation, in the current state, image processing takes too much time so it is difficult to perform traffic monitoring on all traveling vehicles.

Separate from the prior art as described above, a vehicular monitoring method for road traffic using radio waves has been proposed as a scheme wherein transmission signals are output from a transceiver installed at one end of a leaky coaxial cable, the waves reflected from a target object are received and thus the position of the vehicle is detected by a vehicle-position detector (Japanese Patent No. 2981888).

However, while the constitution consisting of a leaky coaxial cable laid along the road and a transceiver installed at one end thereof is effective as one technique for capturing the movement of vehicles upon a road, as a road traffic monitoring technique, the determination of the type of vehicle is difficult, and count errors easily occur depending on the situation of the flow of vehicles on a multi-lane road, so this has drawbacks similar to those of other schemes.

On the other hand, transponder schemes wherein the simultaneous determination of positions of aircraft by radar and the triggering of automatic responses of unique identification numbers that identify aircraft serve important roles in aircraft control systems. The Publication of Unexamined Japanese Patent Application JP-A-55-116176 discloses a technique wherein a similar radio wave-based remote identification technology is applied to automatic toll collection systems for vehicles traveling along expressways or other toll roads.

FIG. 12 is an explanatory diagram showing the constitution of a known toll-road automatic toll collection system which uses radio wave-based remote identification technology. In the scheme based on the aforementioned disclosure, when a vehicle 27 carrying a wireless communications device corresponding to the automatic toll collection system passes through a set communications area for a toll gate of the toll road, a roadside antenna 29 installed upon the gate is used for communication between the roadside wireless device 30 of the automatic toll collection system and the wireless device carried by said vehicle 27, so an identification number previously registered for paying tolls is recognized and recorded, and then the vehicle 27 recognized by this identification number is charged a toll based on recorded data for the segment of the toll road traveled. Vehicles can thus pass through the toll gates on toll roads without stopping, and it has other meritorious effects including increasing the carrying capacity of the road by freeing up traffic congestion at toll gates, and also saving labor at the toll gates of toll roads. In addition, in the other hand, the aforementioned automatic toll collection system is a system constitution technology assumed to coexist with conventional payment schemes based on cash or prepaid cards used at the toll gates of toll roads, so the function and role of the system differs from the concept of road traffic monitoring including ordinary roads.

As described above, with the prior art, errors in determining the vehicle type and counting the number of vehicles are unavoidable, and also no technologies for road traffic monitoring systems have been disclosed that are able to perform the automatic monitoring of the complex flow of vehicles at intersections and the like, determine the overall situation of flow, and if necessary, perform the tabulation and measurement of numbers of vehicles by category or registration, and also perform statistical record processing.

On the other hand, in order to achieve actual results in the implementation of various specific road traffic policies including vehicle type, time zone and region-based traffic restrictions, and restrictions on directions and lanes, it is important to develop new road traffic monitoring system technologies that permit the road traffic situation to be determined accurately.

To this end, the present invention came about in consideration of the aforementioned circumstances, and has as its object to provide a novel road traffic monitoring system that can be used effectively in the determination and administrative monitoring of the current road traffic situation from the standpoint of national and regional governmental road management, traffic policies and other aspects, along with determining the situation of usage including the flow of vehicles, types of vehicles and the like, as well as efficiently and automatically obtaining short-term and long-term statistical data.

SUMMARY OF THE INVENTION

The road traffic monitoring system according to the present invention comprises: vehicle-mounted wireless ID devices that are mounted in every vehicle traveling upon a road, that store an encoded identification number containing a vehicle identification number and other ID information, and that transmit some or all of said encoded identification number upon receiving a stipulated request for response, roadside traffic monitoring devices installed at intersections where three or more entrances and exits meet or other strategic traffic monitoring areas, and roadside wireless devices that are installed at every entrance to a monitoring area at which one of said roadside traffic monitoring devices is installed, and at every exit from said monitoring area, that emit a request for response to vehicles that pass through a stipulated monitoring region, and that receive identification numbers transmitted by the vehicle-mounted wireless ID devices of traveling vehicles in response to this request for response, wherein, all roadside wireless devices transmit the identification numbers sent from the vehicle-mounted wireless ID devices of the traveling vehicles to the roadside traffic monitoring devices, and upon receiving identification numbers from the various roadside wireless devices, the roadside traffic monitoring device determines a time series for the position information of vehicles in the monitoring area, thereby identifying the movement status of each vehicle.

In addition, in the aforementioned road traffic monitoring system, when said roadside traffic monitoring device determines that the geographical location of installation of the roadside wireless device that reported the identification number is on an entrance to the monitoring area in question, then a category based on the identification number of the detected vehicle and a temporary record are made, and in the case that the reported identification number is the same as an identification number already present in the records, then the probability of a duplicate measurement due to a temporary halt because of traffic congestion or a traffic signal or the like is high, so the duplicated vehicle detection information is excluded from monitoring.

In addition, in the aforementioned road traffic monitoring system, when said roadside traffic monitoring device detects that a vehicle detected on the entrance and temporarily recorded is detected by a roadside wireless device installed on an exit, it is assumed to have passed from the entrance to the exit on which the various roadside wireless devices are installed, and left the monitoring area, so the temporary record regarding the vehicle in question is deleted.

In addition, in the aforementioned road traffic monitoring system, said roadside traffic monitoring device has a function for generating and a function for sending measured data by tabulating count items such as the number of vehicles that reached said monitoring area, their travel routes and the like, and said measured data is transmitted to a central monitoring device of a central monitoring center that controls all monitoring areas present within an administrative region.

In addition, said central monitoring device of a central monitoring center has a function for further tabulating measured data transmitted from the roadside traffic monitoring devices of various monitoring areas over fixed time intervals, a function for categorizing and recording monitoring data, and a function for displaying monitoring data.

In addition, in the aforementioned road traffic monitoring system, said roadside wireless device operates in coordination with a vehicle detection sensor that uses the technology of an ultrasonic detector, an infrared detector, a magnetic detector, a radio detector or the like which detects a vehicle traveling upon a road, and the request for response by wireless signal is emitted remotely toward the traveling vehicle detected by the vehicle detection sensor.

In addition, the directionality of the transceiver antennas provided on said roadside wireless device suppresses side lobes, and forms a pattern wherein the wireless signal intensity at the boundary with adjacent lanes is 20–40 dB lower than that at the center of the traffic lane, and also, in the exchange of signals with the vehicle-mounted wireless ID device of the traveling vehicle, a spatial arrangement is adopted that prevents the interference of radio signals including those of different traveling vehicles and malfunctions due thereto.

In addition, in the aforementioned road traffic monitoring system, each roadside wireless device is provided with a corresponding vehicle registration number optical reading device for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical reading devices.

In addition, in the aforementioned road traffic monitoring system, each roadside wireless device is provided with a corresponding optical video camera for comparing the vehicle type and body color for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical video camera.

In addition, in the aforementioned road traffic monitoring system, said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

In addition, in the aforementioned road traffic monitoring system, said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

In addition, in the aforementioned road traffic monitoring system, said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means.

In addition, said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

By means of the aforementioned road traffic monitoring system, at a monitoring area where three or more entrances and exits cross, it is possible to collect also the travel routes of passing vehicles as monitoring information, so the determination and administrative monitoring of the current road traffic situation from the standpoint of national and regional governmental road management, and the determination of the situation of usage including the flow of vehicles, types of vehicles and the like, may be performed efficiently.

The above and other objects and features of the invention will become apparent from the following description made with reference to the drawings.

DESCRIPTION OF THE PREFERRED EMBODIMENTS

Figure 1:
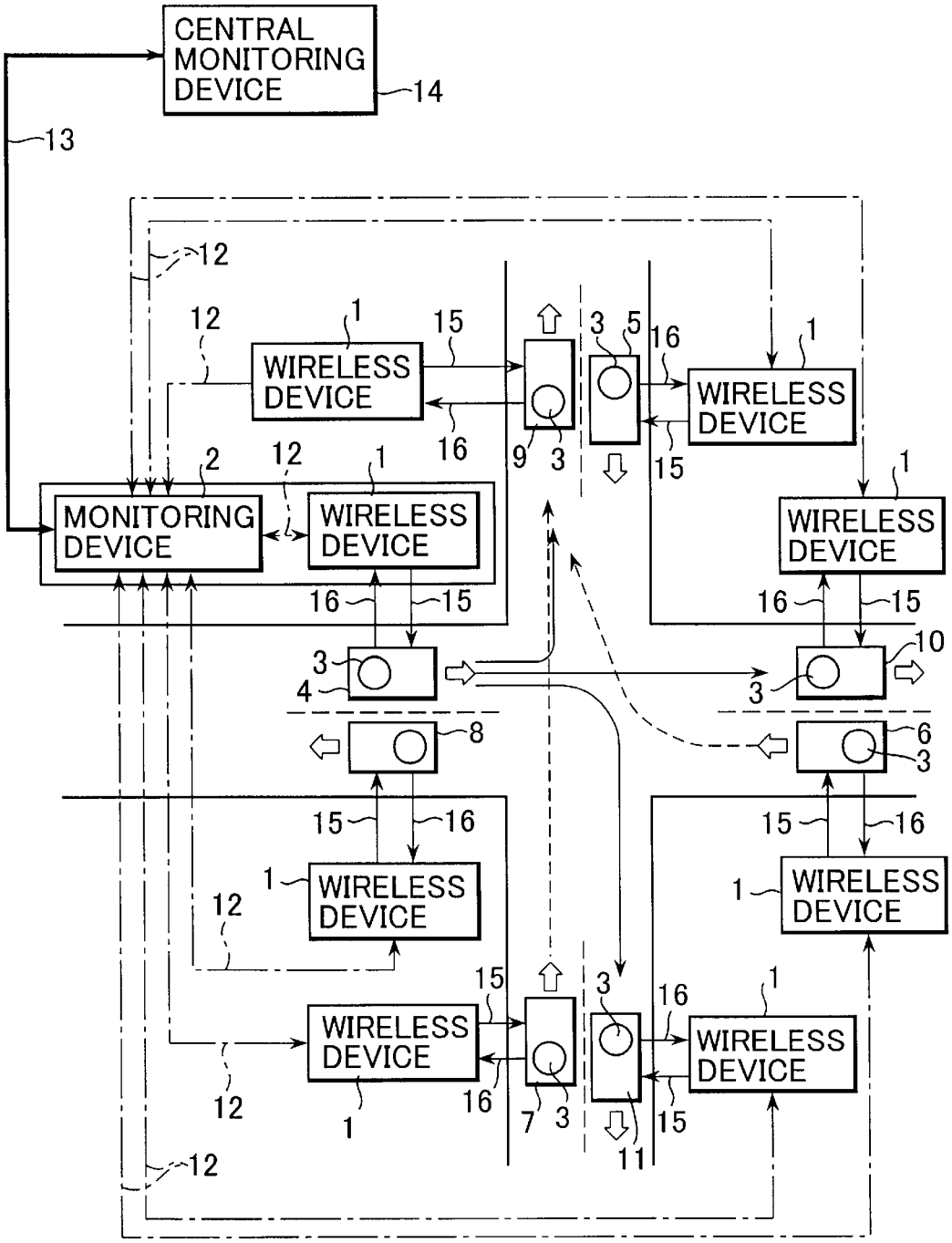
FIG. 1 is a schematic diagram showing the general configuration of a road traffic monitoring system according to the present invention.

Here follows a detailed description of preferred embodiments of the present invention made with reference to the appended diagrams. FIG. 1 is an explanatory diagram an embodiment of a road traffic monitoring system according to the present invention when applied to a four-way intersection which is one example of the monitoring areas.

FIG. 1 shows the case of a basic four-way intersection wherein each of the entrances and exits is a single lane. This system consists of: a roadside wireless device 1 installed at a roadside position corresponding to each of the four entrances to this four-way intersection, or roadside wireless devices 1 . . . each installed at roadside positions corresponding to the traffic lanes for traveling vehicles passing through this intersection, a roadside traffic monitoring device 2 installed at each traffic monitoring area that performs various types of measurement and control, vehicle-mounted wireless ID devices 3 installed in traveling vehicles, signal lines 12 used for bidirectional communication between the roadside wireless devices 1 . . . and the roadside traffic monitoring device 2, a central monitoring device 14 installed in a central monitoring center that controls the entire region, and an optical communications line 13 that connects this central monitoring device 14 to roadside traffic monitoring devices 2 dispersed within the region.

The roadside wireless device 1 transmits to the vehicles entering the intersection a request for response by means of a wireless signal 15 toward the vehicles that pass through the lane monitoring region corresponding to each. The vehicle-mounted wireless ID device 3 of a traveling vehicle that receives the signal keeps as its ID the vehicle registration of that traveling vehicle, its vehicle type and other characteristics of the vehicle encoded as an identification number, and when the aforementioned roadside wireless device 1 receives the request for response by means of the wireless signal 15, the vehicle-mounted wireless ID device 3 transmits all or part of the aforementioned encoded ID as a radio signal 16.

The radio signal 16 transmitted by the vehicle-mounted wireless ID device 3 in this manner is received by each of the roadside wireless devices 1, relayed from this roadside wireless device 1 to the roadside traffic monitoring device 2, and temporarily kept by the roadside traffic monitoring device 2 as an identification number for the vehicle that entered the intersection. The roadside traffic monitoring device 2 is connected by the signal lines 12 to each of the roadside wireless devices 1 installed at various points around the intersection, so it can perform the counting, categorization and counting of traveling vehicles.

In addition, when a vehicle passing through the intersection passes one of its exits, in response to the request for response made by wireless signal 15 from the roadside wireless device 1 installed at the position corresponding to the exit of the traveling vehicle, response information made by radio signal 16 is sent from the vehicle-mounted wireless ID device 3 installed in the traveling vehicle in question to the roadside traffic monitoring device 2 via the signal lines 12. To wit, in the event of a match when compared against the vehicle identification number temporarily stored in the roadside traffic monitoring device 2 as a vehicle entering the intersection, then it may be determined that the traveling vehicle that entered the intersection from some entrance had exited from the intersection at a certain exit.

In short, it is sufficient to be able to identify the entrance and exit in order to determine the direction of exit of a traveling vehicle corresponding to the category of identification number temporarily recorded as a vehicle that entered the monitoring area in question. This can be determined from the position of installation of the roadside wireless device 1 . . . that detected the vehicle, so if one knows on which exit the vehicle detected upon the entrance is detected on the exit, it is possible to determine reliably whether the vehicle in question passed through going straight, passed through the intersection making a right turn or left turn, or made a U-turn and went out in the direction it came.

Accordingly, with a road traffic monitoring system according to this embodiment, it is possible to collect not only the number of vehicles passing through a monitoring area but also information about travel routes including entrances and exits, so it is possible to categorize, count, tabulate and record this information with respect to these collectable data items. Note that the data tabulation may be performed by the roadside traffic monitoring device 2, and it may be transmitted to the central monitoring device 14 at the central monitoring center when a certain amount of data is accumulated, or the raw data may be sent directly to the central monitoring device 14, so that the collection and manipulation of all data is performed by the central monitoring device 14.

The roadside traffic monitoring device 2 in this embodiment deletes from the temporary records the identification numbers of traveling vehicles that have been confirmed to have exited the intersection and excludes them from monitoring, so in the case that a vehicle that has not yet been excluded from monitoring is again detected at an entrance within the monitoring area (in the case that a vehicle identification number newly reported from the roadside wireless device 1 is the same as an identification number already present in the records), there is a good probability of duplicate detection due to a temporary halt caused by traffic congestion or a traffic signal, so the duplicate vehicle detection information may be excluded from monitoring.

In addition, the roadside traffic monitoring device 2 in this embodiment may be provided with, separate from the temporary memory for monitoring traveling vehicles, a monitoring information storage means that is able to keep the various types of monitoring information continuously for longer than a stipulated period of time, so that when stipulated discard conditions (e.g., a certain amount of time has elapsed, or the memory content has exceeded a fixed amount) are met, that monitoring information may be discarded and the monitoring information storage is filled anew. To wit, if the monitoring information is transmitted to the central monitoring device 14 before the discard conditions are met and the monitoring information is discarded, there is no need for it to be stored in the roadside traffic monitoring device 2, so the storage capacity of the roadside traffic monitoring device 2 which is limited by its installation location or size may be utilized fully.

The traffic monitoring and measurement data (tabulated data) is transmitted through the optical communications line 13 capable of high-capacity, high-speed data transmission to the central monitoring device 14 installed in the central monitoring device 14 installed in a central monitoring center that controls the entire region. The central monitoring device 14 is connected by optical communications lines 13 to the roadside traffic monitoring devices 2 of many other monitoring areas, and is equipped with functions for the unified display of measured data from all traffic monitoring areas, statistical processing functions, and record-storing functions. At the central monitoring center that controls the entire region, it is possible to monitor and survey the actual road traffic situation at any monitoring area at any time, and also, it is possible to accurately determine the actual situation of wide-area traffic flow. Note that naturally, the optical communications lines 13 that connect the roadside traffic monitoring devices 2 at traffic monitoring areas provided in various locations can be replaced partially or entirely with wired communications lines or wireless communications lines.

Figure 2:
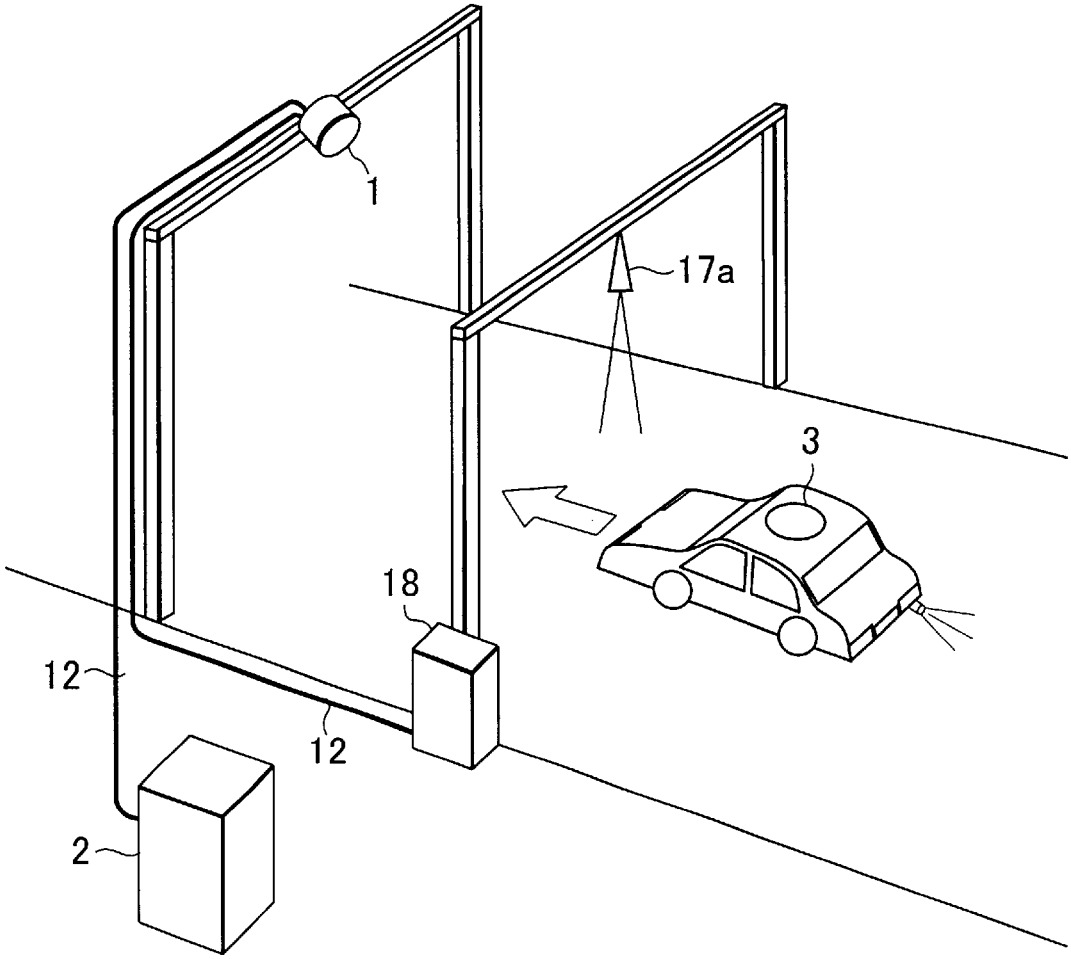
FIG. 2 is a schematic diagram showing the general configuration of another example of the traveling vehicle monitoring portion of the road traffic monitoring system according to the present invention.
Figure 3:
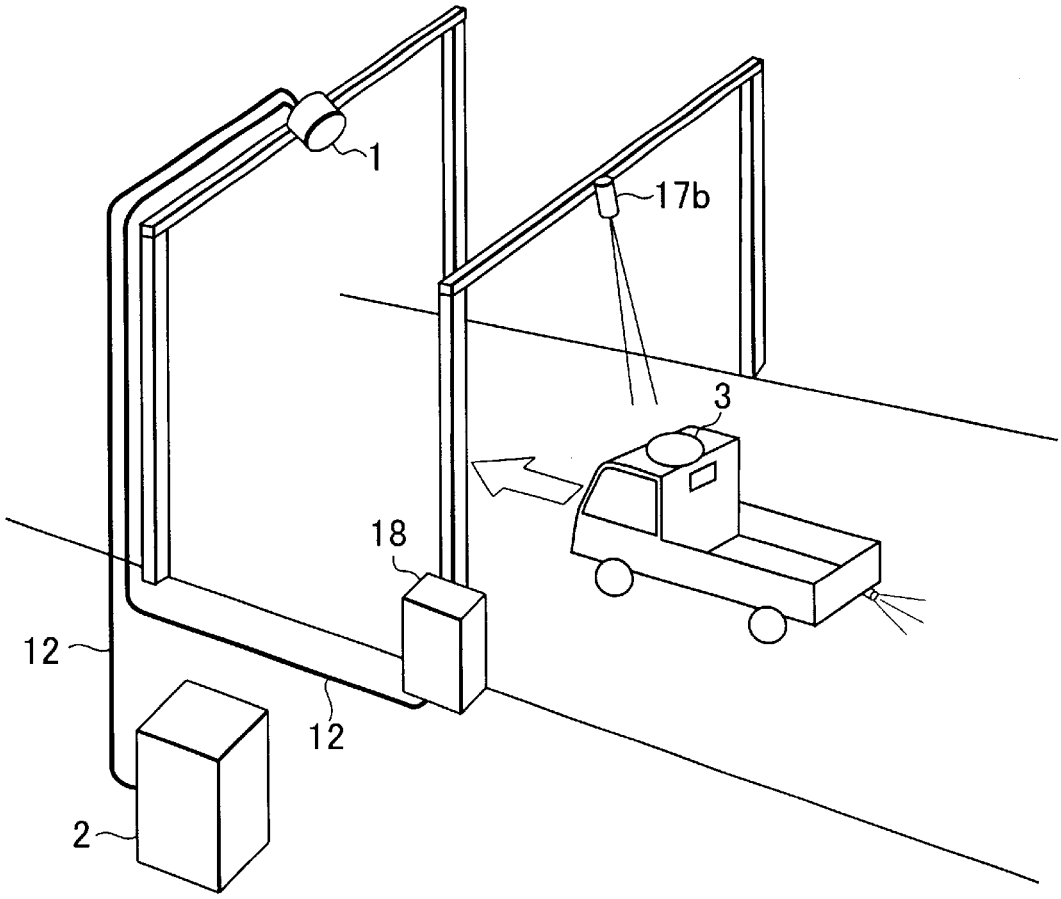
FIG. 3 is a schematic diagram showing the general configuration of another example of the traveling vehicle monitoring portion of the road traffic monitoring system according to the present invention.
Figure 4:
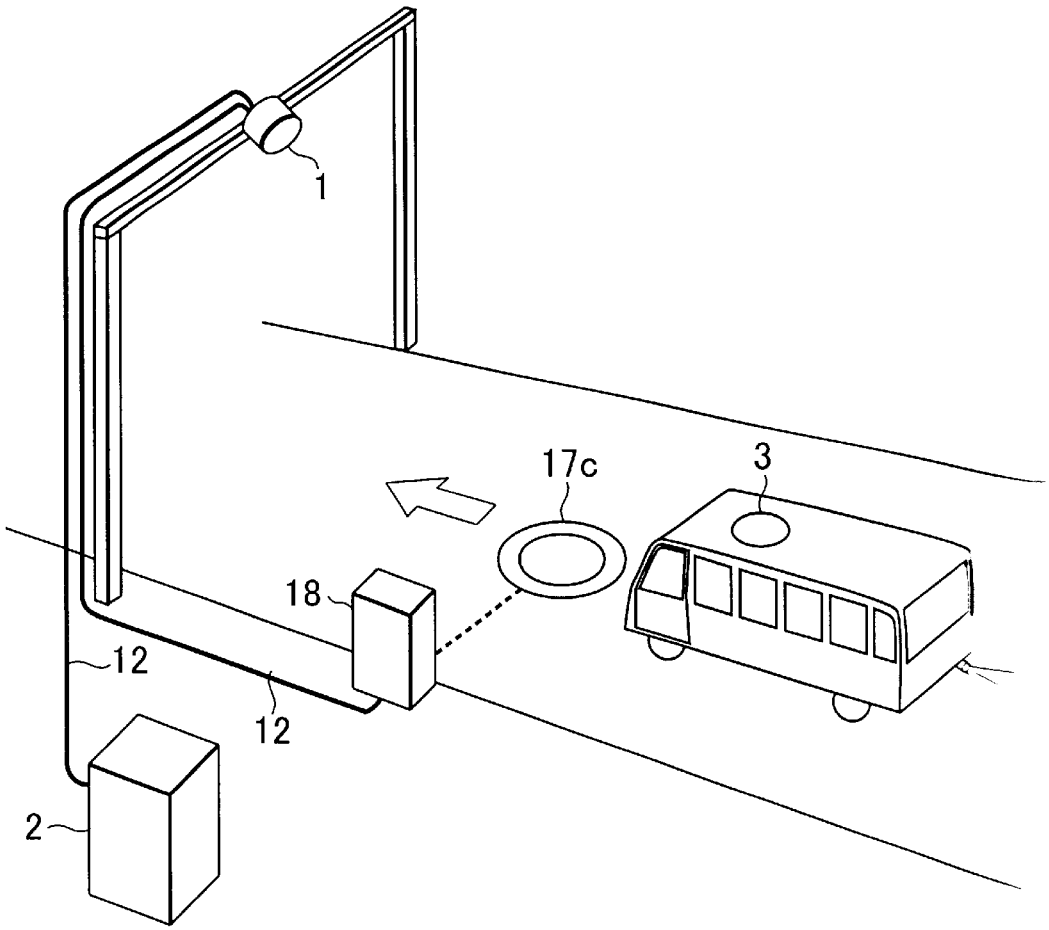
FIG. 4 is a schematic diagram showing the general configuration of another example of the traveling vehicle monitoring portion of the road traffic monitoring system according to the present invention.

FIGS. 2 through 4 are diagrams used to explain the method of detecting vehicles in the road traffic monitoring system according to the present invention. FIG. 2 is an example that combines an ultrasonic sensor 17*a*. FIG. 3 is an example that combines an infrared sensor 17*b*. FIG. 4 is an example of installing a magnetic sensor 17*c* in the road surface of the lane. A traveling vehicle detection sensor 17 that detects vehicles traveling upon the road is installed at a roadside position near the location of installation of the roadside wireless device 1, and the vehicle detection signals from said traveling vehicle detection sensor 17 are received by the roadside wireless device 1 from a sensor controller 18 via signal lines 12, and then the roadside wireless device 1 which was notified of the approach of this car emits a remote request for response by 15 with respect to the most closely approaching traveling vehicle. With this constitution, the traveling vehicle detection sensor used in the example of FIG. 2 is the ultrasonic detector 17*a*, the traveling vehicle detection sensor used in the example of FIG. 3 is the infrared detector 17*b*, while the traveling vehicle detection sensor used in the example of FIG. 4 is the magnetic detector 17*c*.

In any case, by combining with a vehicle detection sensor that detects the approach of a vehicle to the various roadside wireless devices 1 in advance, it is possible for the request for a response by wireless signal 15 to be emitted synchronized to the travel of the vehicle upon the road in the direction of the vehicle-mounted wireless ID device 3 of the traveling vehicle. If so, then it is possible to improve the reliability of measured data and the radiation of unneeded radio waves can be minimized, so the functions of the road traffic monitoring system of the present invention can be effectively achieved. Note that the vehicle detection sensor used may be that according to the aforementioned example, as well as a radio sensor or the like, or various other technologies used as existing vehicle traffic monitoring apparatus. In addition, the sensor controller 18 that receives the detection output of the vehicle detection sensor may also transmit the gist thereof to the corresponding roadside wireless devices 1 . . . and also transmit it to the roadside traffic monitoring device 2.

Figure 5:
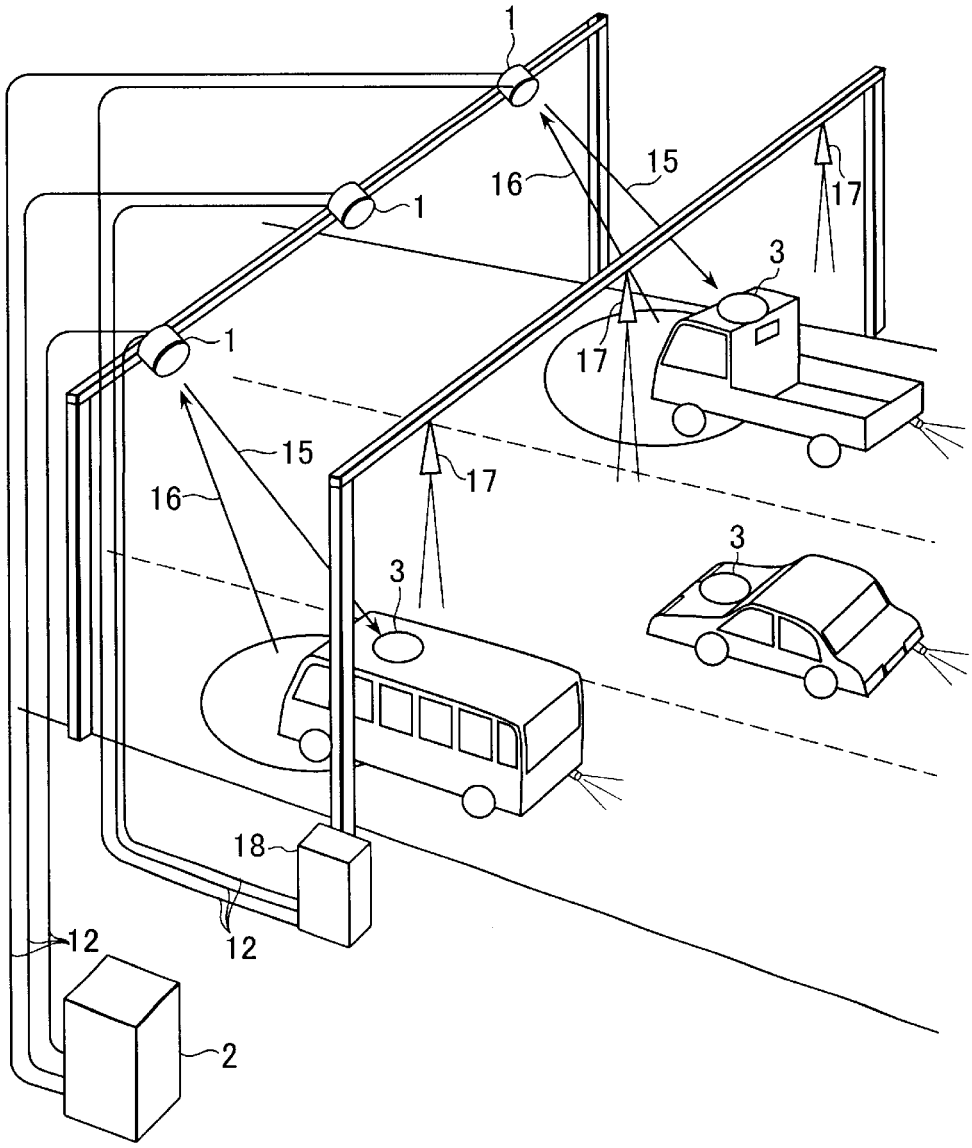
FIG. 5 is a schematic diagram showing the general configuration of another example of the traveling vehicle monitoring portion of the road traffic monitoring system according to the present invention.
Figure 6:
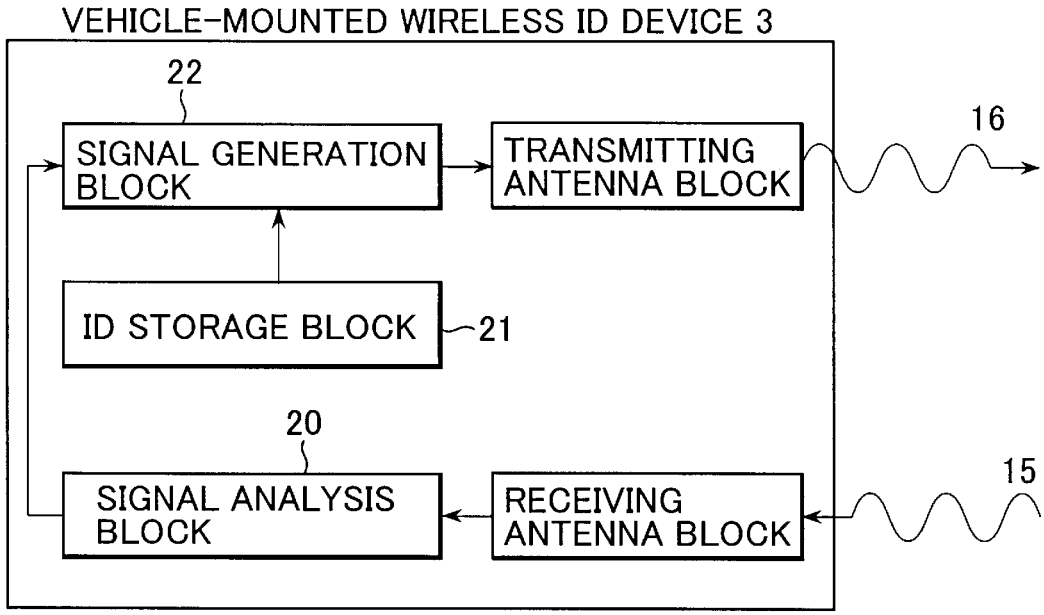
FIG. 6 is a functional block diagram showing the general configuration of a vehicle-mounted wireless ID device.

FIG. 5 is a diagram used to explain another method of detecting vehicles in the road traffic monitoring system according to the present invention. This example shows the case in which the traffic monitoring area consists of a one-way multi-lane road, and roadside wireless devices 1 are installed in parallel corresponding to each of the plurality of lanes, and for each of the lanes, independently installed traveling vehicle detection sensors 17 and sensor controllers 18 are connected to each other. The sensor controller 18 corresponding to the roadside wireless device 1 of the lane on which is installed the traveling vehicle detection sensor 17 that detected a traveling vehicle transmits detection information for the traveling vehicle in that lane. The roadside wireless device 1 that receives this information emits a request for response by wireless signal 15 toward the vehicle-mounted wireless ID device 3 installed in the passing vehicle, thus causing the transmission of all or part of the encoded ID of the passing vehicle traveling on the lane in question as a radio signal 16. The radio signal 16 is received by the roadside wireless device 1 on the corresponding lane and is reported to the roadside traffic monitoring device 2 installed on the roadside within the same monitoring area as an identification number for the traveling vehicle together with the geographical location information of the roadside wireless device 1.

In the roadside traffic monitoring device 2 in question, from the geographical location information of the roadside wireless device 1 that reported the identification number of the traveling vehicle, if that geographical location is an entrance geographical location to an intersection, it is kept as a temporary record within the roadside traffic monitoring device 2. In addition, if the geographical location of the roadside wireless device 1 that reported the identification of the traveling vehicle is a report from the roadside wireless device 1 installed at another exit geographical location within the same monitoring area, from the traveling identification number kept as a temporary record, it is judged to be a case where a traveling vehicle having a matching traveling identification number has passed through and exited from the intersection, so at the same time that the procedure of erasing it from the temporary storage device is performed, it is accumulated and recorded in the roadside traffic monitoring device 2 after attaching the category information required for the purpose of traffic monitoring, including the entrance and exit routes to intersections and the type of traveling vehicle and registered region and the like.

To wit, according to this embodiment, even in the case of areas pertaining to intersections and the like in which there is a large road or multiple exiting or entering lanes, it is still possible to determine the traveling routes of passing vehicles without trouble and collect data.

Note that in order for the request for response by wireless signal 15 from the roadside wireless device 1 installed on the roadside on roads having multiple lanes as shown in FIG. 5 to be transmitted only to vehicles traveling on the lane in question, and for the radio signal 16 response from the vehicle traveling upon the lane in question to be received separately with a high degree of selectivity, when making a request for response by wireless signal 15 sent from the roadside wireless device 1, it is effective to use a weak radio signal, and set the directivity of the transmission antennas of each of the roadside wireless device 1 and the directivity of the receiving antennas to a wireless signal intensity 20–40 dB lower at the boundary with the adjacent lane in comparison to the wireless signal intensity at the central region of the lane, and moreover, it should have a shape such that the directivity characteristics suppress side lobes.

Doing this contributes to improving system reliability by sufficiently lowering the probability of a vehicle outside the lane receiving the request for response by wireless signal 15, and this vehicle outside the lane erroneously recognizing it as a request for response by wireless signal 15 from the roadside wireless device 1 of its lane, thereby returning a response by radio signal 16. In addition, even if a passing vehicle traveling in an adjacent lane should receive a request for response by wireless signal 15 sent as a weak signal from the roadside wireless device 1 of a different lane than the lane on which the vehicle is traveling, and emits a response signal as a radio signal 16 from the adjacent lane, because of the directionality of the receiving antenna of the roadside wireless device 1, a sufficiently large difference in the response signal level will appear in responses from different lanes, so this can be separated as a response from a different lane.

Moreover, by using a directional antenna characteristic with side lobes suppressed so that directionality drops quickly in the vicinity of the lanes for the antennas of the multiple roadside wireless devices 1 connected to the roadside traffic monitoring device 2, in the exchange of the request for response by wireless signal 15 and the response by radio signal 16 from the traveling vehicle between the roadside wireless device 1 and the vehicle-mounted wireless ID device, it is possible to effectively prevent measurement malfunctions due to radio interference with the exchange of radio symbols with different traveling vehicles.

Moreover, typical locations of installation of the antenna of the roadside wireless device 1 include installation in the vicinity of signal lights, and fixed installation above a lane in the vicinity of vehicle detection sensor. In the case of a road consisting of many lanes, depending on the topography and structures in the vicinity, or the types of vehicle detection sensors to be combined, the location of installation of the roadside wireless device 1 may be modified by adopting a method wherein the location of installation is shifted forward or backward in the direction of travel for each vehicle travel lane, or the transceiver antenna directivity may be modified in a combination installation, or other means of spatially avoiding the effects of interference may be effective in practice. In addition to the aforementioned methods of adopting spatial diversity, it is also possible to adopt methods involving frequency diversity by shifting the frequencies of the request for response by wireless signal 15 from the roadside wireless device 1, and using different frequencies for the responses by radio signal 16 from the vehicle-mounted wireless ID device 3 installed on traveling vehicles, thus preventing them from interfering with each other. In addition, other modifications are also conceivable, including using a method of adding a different digital code to the wireless signal 15 for each lane, thereby decreasing the interference with vehicles traveling in different lanes.

FIG. 65 is a diagram showing a schematic structural example of the vehicle-mounted wireless ID device 3 in the road traffic monitoring system according to the present invention. The vehicle-mounted wireless ID device 3 has a receiving antenna block that receives a request for response by wireless signal 15 from the roadside wireless device 1 and an ID storage block 21 that stores an encoded identification number containing the vehicle identification number, vehicle type and other characteristics of the vehicle. A signal analysis block 20 identifies a request for response from the roadside wireless device 1, and in order to return the identification number in response to the request, a signal generation block 22 is activated to generate a radio signal 16, and the radio signal 16 is transmitted from a transmitting antenna block in response in the direction of the roadside wireless device 1.

Note that as the frequency band for the radio waves used by the roadside wireless device 1 and vehicle-mounted wireless ID device 3 in the road traffic monitoring system, it is technically possible to use the microwave/millimeter wave band from 5 GHz to 100 GHz. Specifically, one strong candidate is using a portion of the 5.8 GHz frequency band allocated for ITS (intelligent transportation systems). In addition, the millimeter wave in the 60 GHz band corresponds to the resonance absorption band for oxygen in the atmosphere, so this is a frequency wherein the problem of mutual interference is less of a problem than with radio waves of other frequency bands, and moreover, the wavelength of the radio waves is short so it has an advantage in that a sharp antenna directionality characteristic can be achieved in small antennas. Thus, this is thought to be the most appropriate frequency band if development proceeds into new millimeter-wave device technologies in which cost reductions are achieved through mass production. In addition, existing known technology can be appropriately applied to the specific device configuration including the ID encoding scheme for vehicle identification and the frequency band of the vehicle-mounted wireless ID device used in the road traffic monitoring system according to the present invention.

However, on the other hand, in order to implement the road traffic monitoring system according to the present invention, it is assumed that all traveling vehicles would be equipped with an electronic vehicle-mounted wireless ID device at the same time as the issuance of a license plate currently done at the time of a vehicle registration, and that an obligatory inspection of said vehicle-mounted wireless ID device for would be regularly performed to ensure correct operation, since counterfeiting and modification would be prohibited in the same manner as a license plate, so there are portions that depend on its adoption as a new governmental system.

Figure 7:
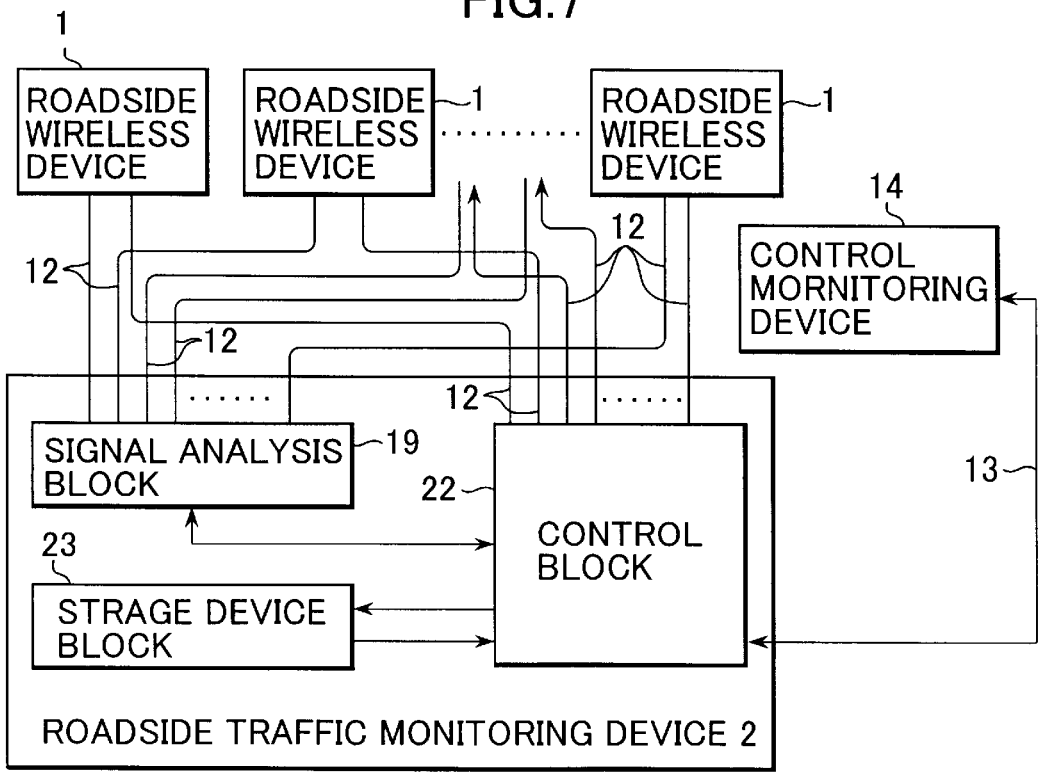
FIG. 7 is a functional block diagram showing the general configuration of a roadside traffic monitoring device.

FIG. 7 is a diagram showing the schematic constitution of the roadside traffic monitoring device 2 of the road traffic monitoring system according to the present invention. The identification number of a traveling vehicle in a radio signal 16 received by the roadside wireless device 1 is judged by a signal analysis block 19 to be either normal data or not. Based on the functions of the control block 22 that controls traffic monitoring data, in the event that the vehicle identification number transmitted from the vehicle-mounted wireless ID device 3 of the traveling vehicle is judged to be an erroneous signal, the recording and tabulation is not to be performed by the roadside traffic monitoring device 2. In addition, a correlation and comparison is provided for the identification number to be judged so that the same traveling vehicle is not counted two or three times due to a temporary halt due to a traffic signal or traffic congestion. Thus, in the event that an identification number corresponding to the same traveling vehicle from the same geographic point is present within the list of identification numbers kept in storage in the storage device block 23 within the roadside traffic monitoring device 2 as a temporary record from the roadside wireless device 1 installed on a lane entering the traffic monitoring area in question, no additional registration or recording is performed. In addition, regarding reports from the roadside wireless device 1 installed on a lane exiting the traffic monitoring area in question, the immediately previous identification number is held and if it is an identification number corresponding to the same traveling vehicle from the same geographical location, there is a function for omitting the cross-reference with the identification number kept in storage in the storage device block 23 within the roadside traffic monitoring device 2 as a temporary record.

The aforementioned constitution shown in FIG. 7 is a description of the minimum functions necessary for the roadside traffic monitoring device 2, so even without being provided with a continuous storage means for monitoring information, it is sufficient for this to be sent sequentially from the signal generation block 22 to the central monitoring device 14. However, by providing the roadside traffic monitoring device 2 with a monitoring information storage means that continuously stores monitoring information and a designated monitoring information storage means that can store as designated monitoring information for a stipulated period of time from the most recent monitoring information stored in this monitoring information storage means, the following system operation is possible.

For example, in an emergency such as a criminal incident occurring in the vicinity of a monitoring area, when a designated monitoring information storage order is received due to the pressing of an emergency button separately provided on the roadside traffic monitoring device 2 or the receipt of an order signal from the central monitoring center, the roadside traffic monitoring device 2 takes from the most recent monitoring information the monitoring information up until a stipulated amount of time previously, such as the immediately previous 5 minutes or 30 minutes, as stored in the monitoring information storage means, and passes records of the identification numbers of passing vehicles to the designated monitoring information storage means, and saves it separately before being subject to automatic deletion within the monitoring information storage means. Moreover, the identification number information for traveling vehicles in this separately saved designated monitoring information can be extracted via the optical communications line 13 by the central monitoring device 14 to search for vehicles.

With this constitution, by having the roadside traffic monitoring devices 2 at the traffic monitoring areas in the vicinity of the geographical location where a criminal incident occurred separately save a list of the identification numbers of traveling vehicles that had passed by immediately after the occurrence of the criminal incident, thus leaving it in the state prior to the automatic erasure of the monitoring information storage means of the roadside traffic monitoring device 2, so details can be retrieved with the central monitoring device 14. Thus, a stolen car fleeing from the crime scene can be tracked with respect to its route and direction, and by also using a function for registering the identification number of traveling vehicles, escape becomes essentially impossible. In addition, even in the even that a complete identification number is not obtained, the identification numbers of traveling vehicles that passed by a traffic monitoring area immediately after the occurrence of a criminal incident involving a vehicle can be used to narrow down the possibilities to a limited number of candidate vehicles, so the corresponding vehicle can be easily deduced. Thus, hit-and-run would become a crime with no possibility of succeeding and also, stolen cars which are often used in crimes will be registered on a list of wanted cars, so this may have a powerful effect of suppressing crime involving the use of cars.

Figure 8:
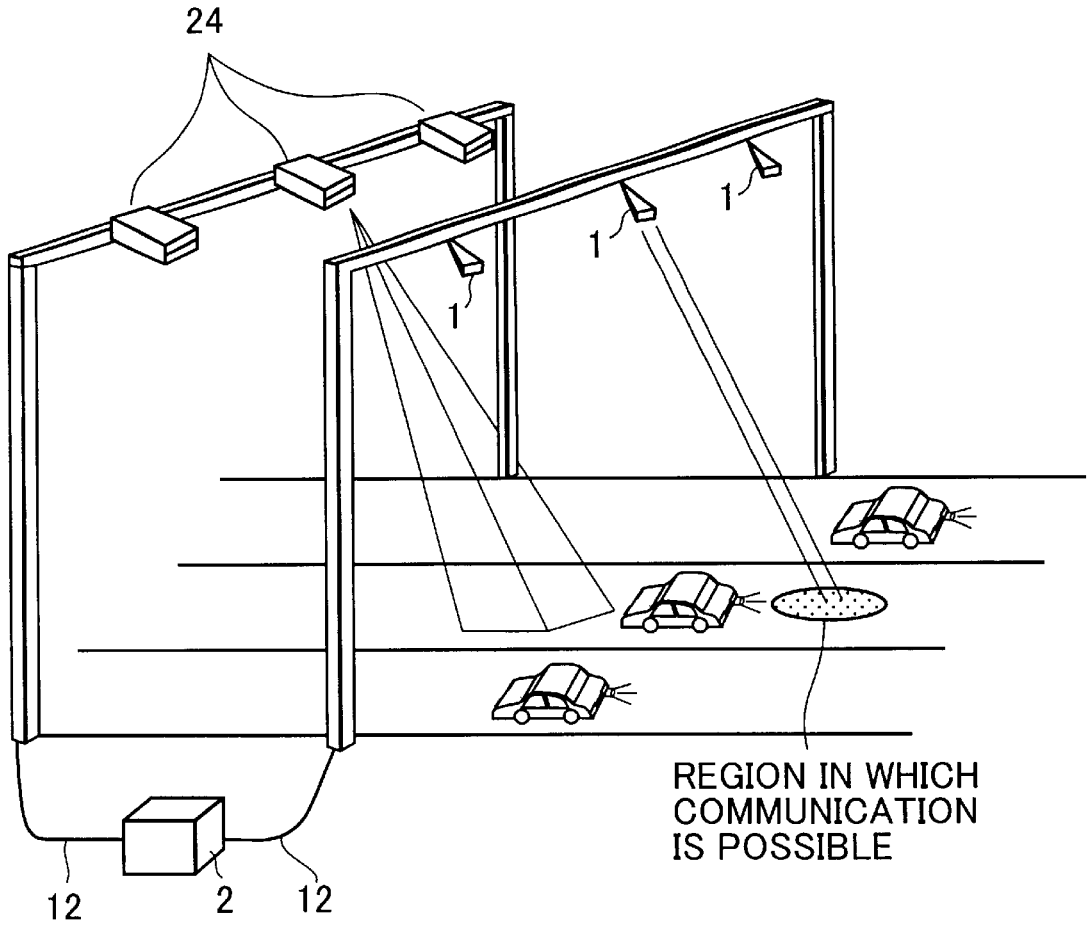
FIG. 8 is a schematic diagram showing the general configuration of another example of the traveling vehicle monitoring portion of the road traffic monitoring system according to the present invention.

FIG. 8 is a diagram used to describe in more detail the constitution of roadside traffic monitoring by the road traffic monitoring system according to the present invention. To wit, in the roadside traffic monitoring shown in this diagram, by adding an optical reading device 24 to the roadside wireless device 1, it is possible to monitor for contradictions between the content of the identification number indicating the characteristics of the traveling vehicles received through the roadside traffic monitoring device 2 connected to the roadside wireless device 1 and optical reading device 24 and the registration number of the traveling vehicles and other registered vehicle information. Thus, the roadside traffic monitoring device 2 can be provided with a function for comparing the results obtained from both the roadside wireless device 1 and the optical reading device 24, so that in the event that a discrepancy occurs with respect to preset comparison items, then the identification number and license plate reading results are recorded and reported to the central monitoring center.

Figure 9:
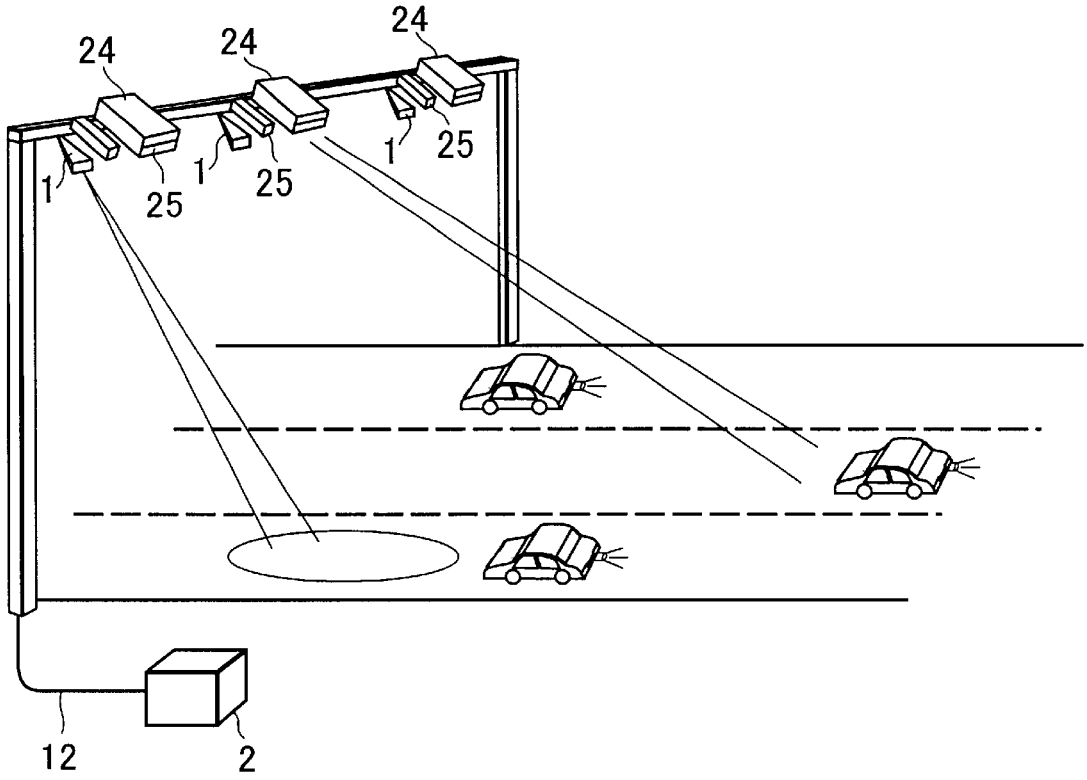
FIG. 9 is a schematic diagram showing the general configuration of another example of the traveling vehicle monitoring portion of the road traffic monitoring system according to the present invention.
Figure 10:
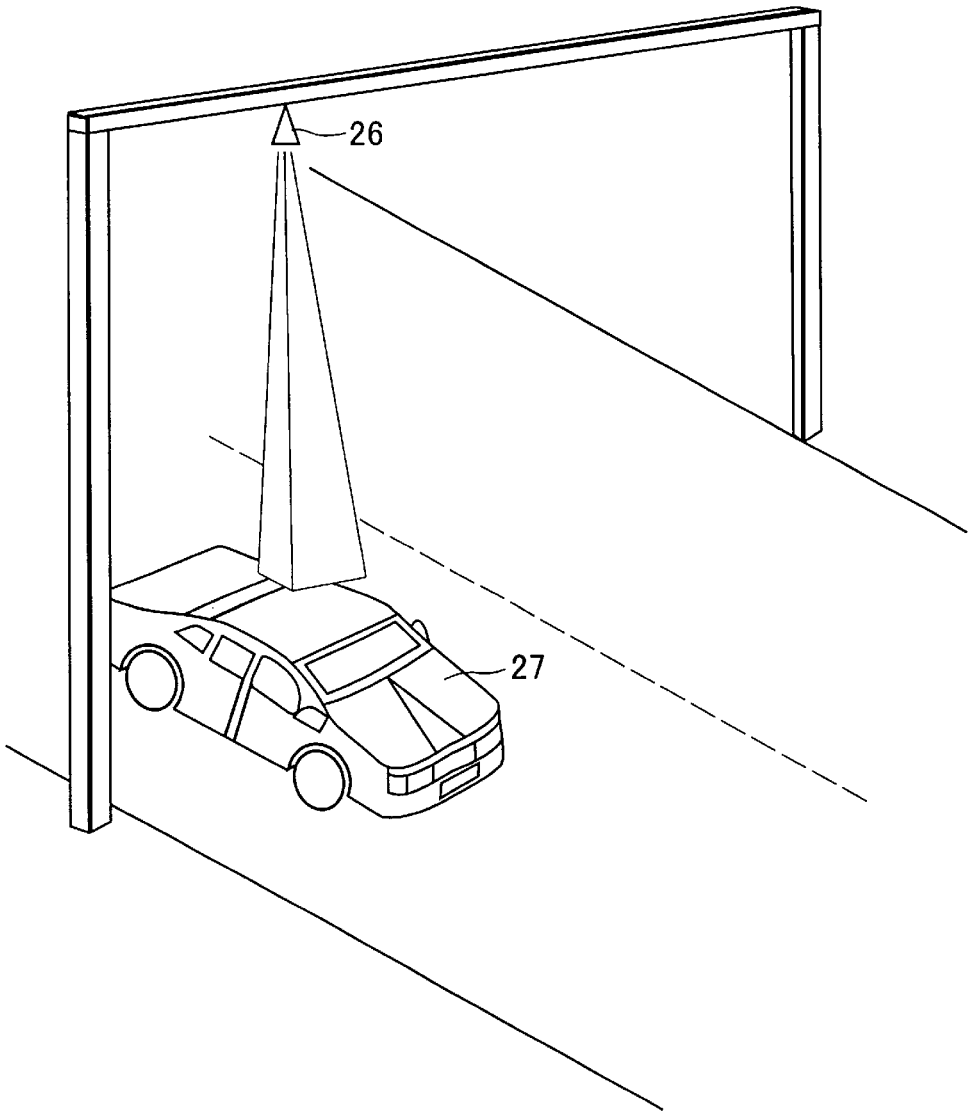
FIG.10 (PRIOR ART)
FIG. 10 is an explanatory diagram showing an example of a prior-art road traffic monitoring system.
Figure 11:
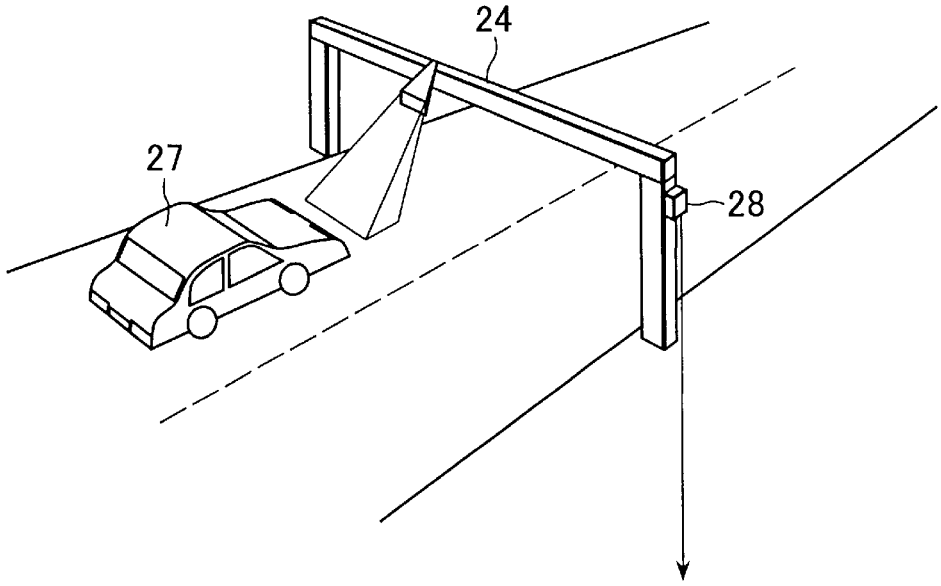
FIG.11 (PRIOR ART)
FIG. 11 is an explanatory diagram showing an example of a prior-art road traffic monitoring system.
Figure 12:
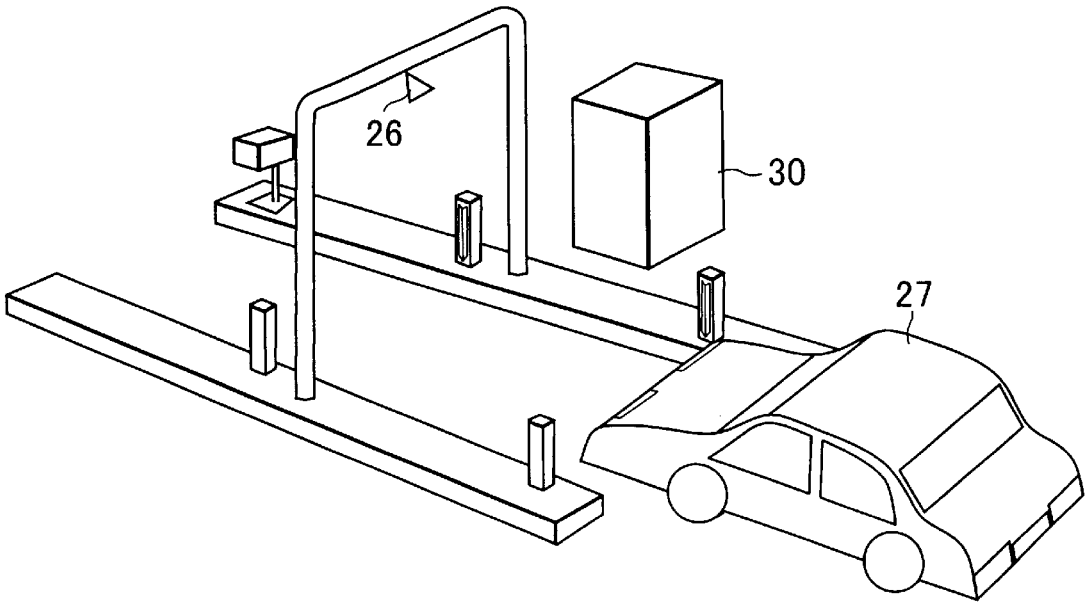
FIG.12 (PRIOR ART)
FIG. 12 is an explanatory diagram showing an example of a prior-art road traffic monitoring system.

FIG. 9 shows the same constitution as that shown in FIG. 8 with the further addition of an optical video camera 25 for comparing and confirming the vehicle type and body color. The roadside traffic monitoring device 2 can be provided with a function for comparing the results obtained from each of the roadside wireless device 1, the optical reading device 24 and the optical video camera 25, so that in the event that a discrepancy occurs with respect to preset comparison items, then the identification number, license plate reading results and optical imaging results of the traveling vehicle are recorded and reported to the central monitoring center.

At a traffic monitoring area incorporating a road traffic monitoring system based on the configuration of FIG. 8 or FIG. 9, it is possible to use the vehicle registration number optical reading device 24 and optical video camera 25 for comparing the vehicle type and body color synchronized to the passage of a traveling vehicle, so it is possible to identify faults in the vehicle-mounted wireless ID devices of traveling vehicles and the passage of vehicles that do not give appropriate responses due to illegal modifications, and also detect the presence of traveling cars that are unidentifiable due to the license plate being covered or forgery or the like. The encoded response signals from the vehicle-mounted wireless ID devices of traveling vehicles in response to requests for response by wireless signal from the roadside wireless device 1 can be used to monitor forgery or illegal modification of vehicle-mounted wireless ID devices. In the situation in which a contradiction in the vehicle identification signal occurs, the optical video camera recognition information and the vehicle identification number information are compared in combination to monitor for the passage of traveling cars suspected of having illegal modifications to the vehicle-mounted wireless ID device or vehicle, or a faulty vehicle-mounted wireless ID device. Based on previously selected and set criteria, the characteristics of traveling vehicles suspected to be faulty or in violation and their vehicle identification number are transmitted to the central monitoring device together with the information about the geographical location and position that the vehicle passed, so prompt and accurate response is possible. Thus the system is expected to have the effect of averting traffic violations and illegal acts involving other crimes.

In addition, the roadside traffic monitoring device 2 may be given a constitution where it is provided with: specific-vehicle recognition information storage means that stores specific-vehicle identification information entered from outside including the vehicle registration number, vehicle type or other vehicle characteristics of specific vehicles, and specific-vehicle search means for searching for the presence of information pertaining to a specific vehicle within information acquired regarding vehicles that are traveling upon the road in a monitoring area in question, thereby automatically checking to see if a specific vehicle is included within the vehicles passing through a monitoring area. More specifically, based upon orders from a central monitoring center that controls a region, part or all of the identification numbers of a single or multiple vehicles may be stored in the specific-vehicle recognition information storage means of the roadside traffic monitoring device 2, thereby registering a specific vehicle subject to a search, and then the identification number comparison function used at the time of monitoring the flow of traveling vehicles may also be used to search for the passage of specific vehicles that match this identification number. Thereby, it is possible to search for vehicles involved in traffic violations, stolen vehicles, and other vehicles that are wanted in regard to traffic crimes or brutal crimes within the geographical region that the vehicle in question is predicted to pass through, so the locations and times at which the vehicle in question passed monitoring areas can be easily determined, and thus it can contribute to solving crimes quickly and preventing crime.

The above is a detailed description of the present invention based on embodiments, but the embodiments disclosed in this Specification are all examples, so the present invention is in no way limited to the disclosed technologies. To wit, the technological scope of the present invention should not be interpreted in a limiting manner based on the aforementioned description of the embodiments, but rather it should be interpreted solely according to the scope of the patent claims, and comprises any technology equivalent to the technology recited in the scope of the patent claims and all modifications within the scope of the patent claims.

By means of the road traffic monitoring system according to the present invention, it is possible to collect monitoring information regarding the routes traveled by vehicles passing monitoring areas where three or more entrances or exits, so it is possible to collect and manage traffic monitoring information not conventionally available, and thus it can achieve the presentation of accurate and prompt traffic information, and thus it has extremely high practical value. Moreover, it can be made into a system that is able to gather and present detailed vehicular information with respect to the investigation of hit-and-run accidents, stolen vehicles, or other criminal incidents involving vehicles, so it can also be expected to have a major effect in contributing to the quick resolution of traffic violations and crimes involving vehicles, and thus it has a crime suppression effect.

What is claimed is:

1. A road traffic monitoring system, which comprises:

vehicle-mounted wireless ID devices that are mounted in every vehicle traveling upon a road, that store an encoded identification number containing a vehicle identification number and other ID information, and that transmit some or all of said encoded identification number upon receiving a stipulated request for response;

roadside traffic monitoring devices installed at intersections where three or more entrances and exits meet or other strategic traffic monitoring areas; and roadside wireless devices that are installed at every entrance to a monitoring area at which one of said roadside traffic monitoring devices is installed, and at every exit from said monitoring area, that emit a request for response to vehicles that pass through a stipulated monitoring region, and that receive identification numbers transmitted by the vehicle-mounted wireless ID devices of traveling vehicles in response to this request for response, wherein, all roadside wireless devices transmit the identification numbers sent from the vehicle-mounted wireless ID devices of the traveling vehicles to the roadside traffic monitoring devices, and upon receiving identification numbers from the various roadside wireless devices, the roadside traffic monitoring device determines a time series for the position information of vehicles in the monitoring area, thereby identifying the movement status of each vehicle.

2. The road traffic monitoring system according to claim 1, wherein when said roadside traffic monitoring device determines that the geographical location of installation of the roadside wireless device that reported the identification number is on an entrance to the monitoring area in question, then a category based on the identification number of the detected vehicle and a temporary record are made, and in the case that the reported identification number is the same as an identification number already present in the records, then the probability of a duplicate measurement due to a temporary halt is high, so the duplicated vehicle detection information is excluded from monitoring, and wherein when said roadside traffic monitoring device detects that a vehicle detected on the entrance and temporarily recorded is detected by a roadside wireless device installed on an exit, it is assumed to have passed from the entrance to the exit on which the various roadside wireless devices are installed, and left the monitoring area, so the temporary record regarding the vehicle in question is deleted.

3. The road traffic monitoring system according to claim 2, wherein said roadside traffic monitoring device has a function for generating and a function for sending measured data by tabulating count items including the number of vehicles that reached said monitoring area, and said measured data is transmitted to a central monitoring device of a central monitoring center that controls all monitoring areas present within an administrative region, and wherein said central monitoring device of a central monitoring center has a function for further tabulating measured data transmitted from the roadside traffic monitoring devices of various monitoring areas over fixed time intervals, a function for categorizing and recording monitoring data, and a function for displaying monitoring data.

4. The road traffic monitoring system according to claim 3, wherein said roadside wireless device operates in coordination with a vehicle detection sensor configured to detect a vehicle traveling upon a road, and the request for response by wireless signal is emitted remotely toward the traveling vehicle detected by the vehicle detection sensor.

5. The road traffic monitoring system according to claim 4, wherein the directionality of the transceiver antennas provided on said roadside wireless device suppresses side lobes, and forms a pattern wherein the wireless signal intensity at the boundary with adjacent lanes is 20–40 dB lower than that at the center of the traffic lane, and also, in the exchange of signals with the vehicle-mounted wireless ID device of the traveling vehicle, a spatial arrangement is adopted that prevents the interference of radio signals including those of different traveling vehicles and malfunctions due thereto.

6. The road traffic monitoring system according to claim 5, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

7. The road traffic monitoring system according to claim 6, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

8. The road traffic monitoring system according to claim 7, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

9. The road traffic monitoring system according to claim 5, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

10. The road traffic monitoring system according to claim 9, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

11. The road traffic monitoring system according to claim 4, wherein each roadside wireless device is provided with a corresponding vehicle registration number optical reading device for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical reading devices.

12. The road traffic monitoring system according to claim 11, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

13. The road traffic monitoring system according to claim 12, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

14. The road traffic monitoring system according to claim 13, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

15. The road traffic monitoring system according to claim 11, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

16. The road traffic monitoring system according to claim 15, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

17. The road traffic monitoring system according to claim 4, wherein each roadside wireless device is provided with a corresponding optical video camera for comparing the vehicle type and body color for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical video camera.

18. The road traffic monitoring system according to claim 17, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

19. The road traffic monitoring system according to claim 18, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

20. The road traffic monitoring system according to claim 19, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

21. The road traffic monitoring system according to claim 17, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

22. The road traffic monitoring system according to claim 21, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

23. The road traffic monitoring system according to claim 4, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

24. The road traffic monitoring system according to claim 23, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

25. The road traffic monitoring system according to claim 24, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

26. The road traffic monitoring system according to claim 4, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

27. The road traffic monitoring system according to claim 26, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

28. The road traffic monitoring system according to claim 3, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

29. The road traffic monitoring system according to claim 28, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

30. The road traffic monitoring system according to claim 29, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

31. The road traffic monitoring system according to claim 3, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

32. The road traffic monitoring system according to claim 31, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

33. The road traffic monitoring system according to claim 2, wherein said roadside wireless device operates in coordination with a vehicle detection sensor configured to detect a vehicle traveling upon a road, and the request for response by wireless signal is emitted remotely toward the traveling vehicle detected by the vehicle detection sensor.

34. The road traffic monitoring system according to claim 33, wherein the directionality of the transceiver antennas provided on said roadside wireless device suppresses side lobes, and forms a pattern wherein the wireless signal intensity at the boundary with adjacent lanes is 20–40 dB lower than that at the center of the traffic lane, and also, in the exchange of signals with the vehicle-mounted wireless ID device of the traveling vehicle, a spatial arrangement is adopted that prevents the interference of radio signals including those of different traveling vehicles and malfunctions due thereto.

35. The road traffic monitoring system according to claim 34, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

36. The road traffic monitoring system according to claim 35, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

37. The road traffic monitoring system according to claim 36, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

38. The road traffic monitoring system according to claim 34, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

39. The road traffic monitoring system according to claim 38, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

40. The road traffic monitoring system according to claim 33, wherein each roadside wireless device is provided with a corresponding vehicle registration number optical reading device for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical reading devices.

41. The road traffic monitoring system according to claim 40, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

42. The road traffic monitoring system according to claim 41, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

43. The road traffic monitoring system according to claim 42, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

44. The road traffic monitoring system according to claim 40, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

45. The road traffic monitoring system according to claim 44, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

46. The road traffic monitoring system according to claim 33, wherein each roadside wireless device is provided with a corresponding optical video camera for comparing the vehicle type and body color for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical video camera.

47. The road traffic monitoring system according to claim 46, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

48. The road traffic monitoring system according to claim 47, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

49. The road traffic monitoring system according to claim 48, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

50. The road traffic monitoring system according to claim 46, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

51. The road traffic monitoring system according to claim 50, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

52. The road traffic monitoring system according to claim 33, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

53. The road traffic monitoring system according to claim 52, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

54. The road traffic monitoring system according to claim 53, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

55. The road traffic monitoring system according to claim 33, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

56. The road traffic monitoring system according to claim 55, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

57. The road traffic monitoring system according to claim 2, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle, within information acquired regarding vehicles that are traveling upon the road in said monitoring area.

58. The road traffic monitoring system according to claim 57, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

59. The road traffic monitoring system according to claim 58, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

60. A The road traffic monitoring system according to claim 2, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

61. The road traffic monitoring system according to claim 60, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

62. The road traffic monitoring system according to claim 1, wherein said roadside traffic monitoring device has a function for generating and a function for sending measured data by tabulating count items including the number of vehicles that reached said monitoring area, and said measured data is transmitted to a central monitoring device of a central monitoring center that controls all monitoring areas present within an administrative region, and wherein said central monitoring device of a central monitoring center has a function for further tabulating measured data transmitted from the roadside traffic monitoring devices of various monitoring areas over fixed time intervals, a function for categorizing and recording monitoring data, and a function for displaying monitoring data.

63. The road traffic monitoring system according to claim 3, wherein said roadside wireless device operates in coordination with a vehicle detection sensor configured to detect a vehicle traveling upon a road, and the request for response by wireless signal is emitted remotely toward the traveling vehicle detected by the vehicle detection sensor.

64. The road traffic monitoring system according to claim 63, wherein the directionality of the transceiver antennas provided on said roadside wireless device suppresses side lobes, and forms a pattern wherein the wireless signal intensity at the boundary with adjacent lanes is 20–40 dB lower than that at the center of the traffic lane, and also, in the exchange of signals with the vehicle-mounted wireless ID device of the traveling vehicle, a spatial arrangement is adopted that prevents the interference of radio signals including those of different traveling vehicles and malfunctions due thereto.

65. The road traffic monitoring system according to claim 64, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

66. The road traffic monitoring system according to claim 65, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

67. The road traffic monitoring system according to claim 66, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

68. The road traffic monitoring system according to claim 64, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

69. The road traffic monitoring system according to claim 68, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

70. The road traffic monitoring system according to claim 63, wherein each roadside wireless device is provided with a corresponding vehicle registration number optical reading device for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical reading devices.

71. The road traffic monitoring system according to claim 70, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

72. The road traffic monitoring system according to claim 71, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

73. The road traffic monitoring system according to claim 72, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

74. The road traffic monitoring system according to claim 70, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

75. The road traffic monitoring system according to claim 74, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

76. The road traffic monitoring system according to claim 63, wherein each roadside wireless device is provided with a corresponding optical video camera for comparing the vehicle type and body color for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical video camera.

77. The road traffic monitoring system according to claim 76, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

78. The road traffic monitoring system according to claim 77, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

79. The road traffic monitoring system according to claim 78, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

80. The road traffic monitoring system according to claim 76, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

81. The road traffic monitoring system according to claim 80, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

82. The road traffic monitoring system according to claim 63, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

83. The road traffic monitoring system according to claim 82, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

84. The road traffic monitoring system according to claim 83, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

85. The road traffic monitoring system according to claim 63, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

86. The road traffic monitoring system according to claim 85, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

87. The road traffic monitoring system according to claim 62, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

88. The road traffic monitoring system according to claim 87, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

89. The road traffic monitoring system according to claim 88, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

90. The road traffic monitoring system according to claim 62, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

91. The road traffic monitoring system according to claim 90, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

92. The road traffic monitoring system according to claim 1, wherein said roadside wireless device operates in coordination with a vehicle detection sensor configured to detect a vehicle traveling upon a road, and the request for response by wireless signal is emitted remotely toward the traveling vehicle detected by the vehicle detection sensor.

93. The road traffic monitoring system according to claim 92, wherein the directionality of the transceiver antennas provided on said roadside wireless device suppresses side lobes, and forms a pattern wherein the wireless signal intensity at the boundary with adjacent lanes is 20–40 dB lower than that at the center of the traffic lane, and also, in the exchange of signals with the vehicle-mounted wireless ID device of the traveling vehicle, a spatial arrangement is adopted that prevents the interference of radio signals including those of different traveling vehicles and malfunctions due thereto.

94. The road traffic monitoring system according to claim 83, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

95. The road traffic monitoring system according to claim 94, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

96. The road traffic monitoring system according to claim 95, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

97. The road traffic monitoring system according to claim 93, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

98. The road traffic monitoring system according to claim 97, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

99. The road traffic monitoring system according to claim 92, wherein each roadside wireless device is provided with a corresponding vehicle registration number optical reading device for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical reading devices.

100. The road traffic monitoring system according to claim 99, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

101. The road traffic monitoring system according to claim 100, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

102. The road traffic monitoring System according to claim 101, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

103. The road traffic monitoring system according to claim 99, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

104. The road traffic monitoring system according to claim 103, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

105. The road traffic monitoring system according to claim 92, wherein each roadside wireless device is provided with a corresponding optical video camera for comparing the vehicle type and body color for monitoring to make sure that some or all of the information of the identification number of traveling vehicles received by said roadside wireless device is not contradictory regarding the traveling vehicle, and said roadside traffic monitoring device has a function for determining the presence of contradictions by comparing the information obtained from both the roadside wireless devices and the optical video camera.

106. The road traffic monitoring system according to claim 105, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

107. The road traffic monitoring system according to claim 106, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

108. The road traffic monitoring system according to claim 107, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

109. The road traffic monitoring system according to claim 105, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

110. The road traffic monitoring system according to claim 109, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

111. The road traffic monitoring system according to claim 92, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

112. The road traffic monitoring system according to claim 111, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

113. The road traffic monitoring system according to claim 112, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

114. The road traffic monitoring system according to claim 92, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

115. The road traffic monitoring system according to claim 114, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

116. The road traffic monitoring system according to claim 1, wherein said roadside traffic monitoring device comprises: specified vehicle identification information storage means that stores specified vehicle identification information entered from outside including the vehicle registration number of a specified vehicle, its vehicle type and other characteristics of the vehicle, and specified vehicle search means that searches for the presence of information pertaining to a specified vehicle within information acquired regarding vehicles that are traveling upon the road in said monitoring area.

117. The road traffic monitoring system according to claim 116, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

118. The road traffic monitoring system according to claim 117, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

119. The road traffic monitoring system according to claim 1, wherein said roadside traffic monitoring device comprises: monitoring information storage means that is able to store and keep monitoring information collected from the various roadside wireless devices continuously for at least a stipulated length of time or more, and when stipulated discard conditions are met, the monitoring information is discarded and the monitoring information storage is filled anew.

120. The road traffic monitoring system according to claim 119, wherein said roadside traffic monitoring device comprises: designated monitoring information storage means that is able to store designated monitoring information among the monitoring information stored in the monitoring information storage means, and upon receiving a designated monitoring information storage order, the roadside traffic monitoring system stores monitoring information up until a stipulated length of time previously among the most recent monitoring information stored in the monitoring information storage means as designated monitoring information in the designated monitoring information storage means, and wherein said central monitoring device of a central monitoring center may transmit a designated monitoring information storage order to a roadside traffic monitoring device at any monitoring area within its administrative region, and also, may extract monitoring information from the designated monitoring information storage means of the roadside traffic monitoring device to which the designated monitoring information storage order was sent.

* * * * *